US008431292B2

(12) United States Patent
Tong et al.

(10) Patent No.: US 8,431,292 B2
(45) Date of Patent: Apr. 30, 2013

(54) CHARGE BLOCKING LAYER AND COATING SOLUTION FOR FORMING THE SAME

(75) Inventors: Yuhua Tong, Webster, NY (US); Edward F. Grabowski, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 888 days.

(21) Appl. No.: 12/478,620

(22) Filed: Jun. 4, 2009

(65) Prior Publication Data

US 2010/0310977 A1 Dec. 9, 2010

(51) Int. Cl.
*G03G 15/04* (2006.01)

(52) U.S. Cl.
USPC ..... 430/64; 430/60

(58) Field of Classification Search ..... 430/56, 430/58.05, 59.1, 60, 64; 427/102; 106/287.11
See application file for complete search history.

(56) References Cited

U.S. PATENT DOCUMENTS

| | | | | |
|---|---|---|---|---|
| 3,121,006 | A | 2/1964 | Middleton et al. | |
| 4,464,450 | A | 8/1984 | Teuscher | |
| 4,587,189 | A | 5/1986 | Hor et al. | |
| 4,921,773 | A | 5/1990 | Melnyk et al. | |
| 5,069,993 | A | 12/1991 | Robinette et al. | |
| 5,215,839 | A | 6/1993 | Yu | |
| 5,660,961 | A | 8/1997 | Yu | |
| 5,733,698 | A | 3/1998 | Lehman et al. | |
| 5,756,245 | A | 5/1998 | Esteghamatian et al. | |
| 5,958,638 | A | 9/1999 | Katayama et al. | |
| 7,344,809 | B2 | 3/2008 | Horgan et al. | |
| 2002/0046682 | A1 * | 4/2002 | Fan et al. | 106/287.11 |
| 2004/0126684 | A1 | 7/2004 | Horgan et al. | |
| 2006/0216620 | A1 * | 9/2006 | Fu et al. | 430/59.6 |
| 2010/0297543 | A1 * | 11/2010 | Tong et al. | 430/56 |

OTHER PUBLICATIONS

European Search Report dated Oct. 5, 2010 for EP Application No. 10163892.2, 3 pages.

* cited by examiner

*Primary Examiner* — Stewart Fraser
(74) *Attorney, Agent, or Firm* — Pillsbury Winthrop Shaw Pittman LLP

(57) ABSTRACT

The present embodiments are generally directed to an improved imaging member exhibiting various advantages over conventional imaging members. More specifically, the present embodiments are directed to an improved charge blocking layer formed from an aqueous-based coating solution which exhibits improved shelf life and coating properties, such as increased homogeneity and adhesion, and methods for making the same. The aqueous-based coating solution is environment-friendly and avoids the need to use more expensive organic solvents which involve higher safety risks in the manufacturing process.

9 Claims, 1 Drawing Sheet

CHARGE BLOCKING LAYER AND COATING SOLUTION FOR FORMING THE SAME

BACKGROUND

The presently disclosed embodiments relate generally to layers that are useful in imaging apparatus members and components, for use in electrostatographic, including digital, apparatuses. More particularly, the embodiments pertain to an electrostatographic imaging member having an improved charge blocking layer formed from an aqueous-based coating solution which exhibits improved shelf life and coating properties, such as increased homogeneity and adhesion, and methods for making the same.

In electrophotographic or electrostatographic printing, the charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as toner. Toner is held on the image areas by the electrostatic charge on the photoreceptor surface. Thus, a toner image is produced in conformity with a light image of the original being reproduced or printed. The toner image may then be transferred to a substrate or support member (e.g., paper) directly or through the use of an intermediate transfer member, and the image affixed thereto to form a permanent record of the image to be reproduced or printed. The process is useful for light lens copying from an original or printing electronically generated or stored originals such as with a raster output scanner (ROS), where a charged surface may be imagewise discharged in a variety of ways.

The described electrostatographic copying process is well known and is commonly used for light lens copying of an original document. Analogous processes also exist in other electrostatographic printing applications such as, for example, digital laser printing or ionographic printing and reproduction where charge is deposited on a charge retentive surface in response to electronically generated or stored images.

Multilayered photoreceptors or imaging members have at least two layers, and may include a substrate, a conductive layer, an optional undercoat layer (sometimes referred to as a "charge blocking layer" or "hole blocking layer"), an optional adhesive layer, a photogenerating layer (sometimes referred to as a "charge generation layer," "charge generating layer," or "charge generator layer"), a charge transport layer, and an optional overcoat layer in either a flexible belt form or a rigid drum configuration. The undercoat layer is designed to block the charge injection from conductive substrate into CGL. The charge generation layer has the function generating free charges upon light exposure, and the function of charge transport layer is to transport the charges from CGL to the surface of photoreceptor. Enhancement of charge transport across these layers provides better photoreceptor performance. Multilayered flexible photoreceptor members may include an anti-curl layer on the backside of the substrate, opposite to the side of the electrically active layers, to render the desired photoreceptor flatness.

Current charge blocking layer in organic photoreceptor devices could be formed by one method of hydrolysis of organosilanes, such as for example, 3-aminopropyltriethoxysilane (γ-APS), using heptanes and ethanol as solvents in the coating process. However, the organic solvents in the process are associated with environmental risks and require high safety protection as well as lead to high manufacturing cost. Due to the limited miscibility between the components in the coating solution, the organic solvent involved coating process can easily have non-uniformity coating and coating defects, which cause poor photoreceptor performance and peel-off problems. As the charge blocking layer is applied on conductive substrate, such as titanium/zirconium metalized Mylar, the adhesion between the undercoat layer and the substrate is critical to maintain the entirety of the photoreceptor device. Thus, improved adhesion is necessary to ensure better photoreceptor performance and long application life.

Thus, there is a need for an improved imaging layer that does not suffer from the above-described problems.

Conventional photoreceptors are disclosed in the following patents, a number of which describe the presence of light scattering particles in the undercoat layers: Yu, U.S. Pat. No. 5,660,961; Yu, U.S. Pat. No. 5,215,839; and Katayama et al., U.S. Pat. No. 5,958,638. The term "photoreceptor" or "photoconductor" is generally used interchangeably with the terms "imaging member." The term "electrostatographic" includes "electrophotographic" and "xerographic." The terms "charge transport molecule" are generally used interchangeably with the terms "hole transport molecule or electron transport molecule."

SUMMARY

According to aspects illustrated herein, there is provided a coating solution for forming a charge blocking layer, comprising one or more functionalized organosilanes, a surfactant, and an optional solvent, wherein the coating solution is aqueous-based.

Another embodiment provides an imaging member comprising a substrate, a charge blocking layer disposed on the substrate, an adhesive interfacial layer disposed on the charge blocking layer, wherein the adhesive interfacial layer is disposed between the charge blocking layer and the charge generation layer, and further wherein the charge blocking layer is formed from an aqueous-based coating solution comprising one or more functionalized organosilanes, a surfactant, and optionally a solvent.

Yet another embodiment, there is provided a process for forming a charge blocking layer, comprising combining and mixing one or more functionalized organosilanes, a surfactant, and optionally a solvent to form an aqueous-based coating solution, mixing the coating solution to initiate hydrolysis of the functionalized organosilanes, and coating the solution on a substrate to form a charge blocking layer.

BRIEF DESCRIPTION OF THE DRAWINGS

For a better understanding, reference may be made to the accompanying figures.

DETAILED DESCRIPTION

Figure 1:
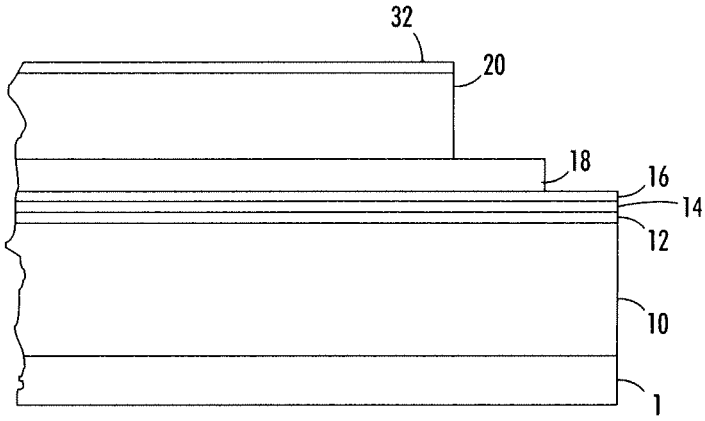
FIG. 1 is a cross-sectional view of an imaging member in a belt configuration according to the present embodiments.

In the following description, reference is made to the accompanying drawings, which form a part hereof and which illustrate several embodiments. It is understood that other embodiments may be used and structural and operational changes may be made without departure from the scope of the present disclosure.

The presently disclosed embodiments are directed generally to an improved electrostatographic imaging member in which the charge blocking layer is formed from an aqueous-based coating solution which avoids the need to use petroleum or organic solvents. A small amount of surfactant is incorporated into the coating solution which achieves both a stable aqueous solution with longer shelf life and better coating quality than conventional charge blocking layer coating solutions using organic solvents. Moreover, the formed charge blocking layer film has improved adhesion with metalized substrate. Testing of the electrical properties of the inventive photoreceptors demonstrated low discharge residual voltage, very stable cycling electrical performance, low charging dark decay and low charging depletion. Thus, the present embodiments provide a low cost and environmentally-friendly process for charge blocking layers in organic photoreceptors having improved imaging performance.

In electrostatographic reproducing or digital printing apparatuses using a photoreceptor, a light image is recorded in the form of an electrostatic latent image upon a photosensitive membrane and the latent image is subsequently rendered visible by the application of a developer mixture. The developer, having charged toner particles contained therein, is brought into contact with the electrostatic latent image to develop the image on an electrostatographic imaging membrane which has a charge-retentive surface. The developed toner image can then be transferred to a copy substrate, such as paper, that receives the image directly from photoreceptor or via an image transfer belt.

The exemplary embodiments of this disclosure are described below with reference to the drawings. The specific terms are used in the following description for clarity, selected for illustration in the drawings and not to define or limit the scope of the disclosure. The same reference numerals are used to identify the same structure in different figures unless specified otherwise. The structures in the figures are not drawn according to their relative proportions and the drawings should not be interpreted as limiting the disclosure in size, relative size, or location. In addition, though the discussion will address negatively charged systems, the imaging members of the present disclosure may also be used in positively charged systems.

FIG. 1 shows an imaging member having a belt configuration according to the embodiments. As shown, the belt configuration is provided with an anti-curl back coating 1, a supporting substrate 10, an electrically conductive ground plane 12, an undercoat layer 14, an adhesive layer 16, a charge generation layer 18, and a charge transport layer 20. An optional overcoat layer 32 may also be included. An exemplary photoreceptor having a belt configuration is disclosed in U.S. Pat. No. 5,069,993, which is hereby incorporated by reference.

The Overcoat Layer

Other layers of the imaging member may include, for example, an optional overcoat layer 32. An optional overcoat layer 32, if desired, may be disposed over the charge transport layer 20 to provide imaging member surface protection as well as improve resistance to abrasion. In embodiments, the overcoat layer 32 may have a thickness ranging from about 0.1 micron to about 10 microns or from about 1 micron to about 10 microns, or in a specific embodiment, about 3 microns. These overcoat layers may include thermoplastic organic polymers or inorganic polymers that are electrically insulating or slightly semi-conductive. For example, overcoat layers may be fabricated from a dispersion including a particulate additive in a resin. Suitable particulate additives for overcoat layers include metal oxides including aluminum oxide, non-metal oxides including silica or low surface energy polytetrafluoroethylene (PTFE), and combinations thereof. Suitable resins include those described above as suitable for photogenerating layers and/or charge transport layers, for example, polyvinyl acetates, polyvinylbutyrals, polyvinylchlorides, vinylchloride and vinyl acetate copolymers, carboxyl-modified vinyl chloride/vinyl acetate copolymers, hydroxyl-modified vinyl chloride/vinyl acetate copolymers, carboxyl- and hydroxyl-modified vinyl chloride/vinyl acetate copolymers, polyvinyl alcohols, polycarbonates, polyesters, polyurethanes, polystyrenes, polybutadienes, polysulfones, polyarylethers, polyarylsulfones, polyethersulfones, polyethylenes, polypropylenes, polymethylpentenes, polyphenylene sulfides, polysiloxanes, polyacrylates, polyvinyl acetals, polyamides, polyimides, amino resins, phenylene oxide resins, phenoxy resins, epoxy resins, phenolic resins, polystyrene and acrylonitrile copolymers, poly-N-vinylpyrrolidinones, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and combinations thereof.

The Substrate

The photoreceptor support substrate 10 may comprise any suitable organic or inorganic material having the requisite mechanical properties. In some photoreceptor designs such as back-exposure erase, the substrate may be optically opaque or substantially transparent. The entire substrate can comprise the same material as that in the electrically conductive surface, or the electrically conductive surface can be merely a coating on the substrate. Any suitable electrically conductive material can be employed, such as for example, metal or metal alloy. Electrically conductive materials include copper, brass, nickel, zinc, chromium, stainless steel, conductive plastics and rubbers, aluminum, semitransparent aluminum, iron, cadmium, silver, gold, zirconium, niobium, tantalum, vanadium, hafnium, titanium, nickel, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and/or oxides.

The substrate 10 can also be formulated entirely of an electrically conductive material, or it can be an insulating material including inorganic or organic polymeric materials, such as MYLAR, a commercially available biaxially oriented polyethylene terephthalate from DuPont, or polyethylene naphthalate available as KALEDEX 2000, with a ground plane layer 12 comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations.

The substrate 10 may have a number of many different configurations, such as for example, a plate, a cylinder, a drum, a scroll, an endless flexible belt, and the like. In the case of the substrate being in the form of a belt, as shown in FIG.

1, the belt can be seamed or seamless. In embodiments, the photoreceptor herein is in a drum configuration.

The thickness of the substrate 10 depends on numerous factors, including flexibility, mechanical performance, and economic considerations. The thickness of the support substrate 10 of the present embodiments may be at least about 50 microns, or no more than about 300 microns, or be at least about 75 microns, or no more than about 250 microns.

The Charge Blocking Layer

On the substrate with a conductive surface, the charge or hole blocking layer 14 may be applied thereto. Electron blocking layers for positively charged photoreceptors allow holes from the charge generation layer of the photoreceptor to migrate toward the conductive substrate. For negatively charged photoreceptors, any suitable hole blocking layer capable of forming a barrier to prevent hole injection from the conductive substrate to the charge generation layer or even to cross over the charge transport layer to the surface of the photoreceptor, may be utilized.

The hole blocking layer should be continuous and have a thickness of less than about 0.5 micron because greater thicknesses may lead to undesirably high discharging residual voltage. A hole blocking layer of between about 0.005 micron and about 0.3 micron is used because charge neutralization after the exposure step is facilitated and optimum electrical performance is achieved. A thickness of between about 0.03 micron and about 0.06 micron is used for hole blocking layers for optimum electrical behavior. The blocking layer may be applied by any suitable conventional technique such as spraying, dip coating, draw bar coating, gravure coating, extrusion die coating, silk screening, air knife coating, reverse roll coating, vacuum deposition, chemical treatment and the like. For convenience in obtaining thin layers, the blocking layer is applied in the form of a dilute solution, with the solvent being removed after deposition of the coating by conventional techniques such as by vacuum, heating and the like.

In the present embodiments, there is provided an improved coating solution for forming a charge blocking layer which avoids the need to use organic solvents which are both costly and involve safety risks in the manufacturing process. In embodiments, the coating solution comprises one or more functionalized organosilanes, a surfactant, and a solvent, wherein the coating solution is aqueous-based. The embodiments incorporate one or more functionalized organosilane compounds include, for example, gamma-aminopropyltriethoxysilane, gamma-glycidoxypropyltrimethoxysilane, N-beta-aminoethyl gamma-aminopropyltrimethoxysilane, gamma-glycidoxypropyl methyldimethoxysilane, gamma-glycidoxypropyl dimethylmethoxysilane, gamma-glycidoxypropyl triethoxysilane, gamma-glycidoxypropyl methyldiethoxysilane, gamma-glycidoxypropyl dimethylethoxysilane, beta-(3,4-epoxycyclohexyl)ethyltrimethoxysilane, beta-(3,4-epoxycyclohexyl)-ethylmethyldimethoxysilane, beta-(3,4-epoxycyclohexyl)ethyldimethylmethoxysilane, beta-(3,4-epoxycyclohexyl) ethyltriethoxysi lane, beta-(3,4-epoxycyclohexyl)-ethylmethyldiethoxysilane, beta-(3,4-epoxycyclohexyl) ethyldimethylethoxysilane, 4-aminobutyltriethoxysilane, hydroxymethyltriethoxysilane, 3-[hydroxy(polyethyleneoxy)propyl]heptamethyltrisiloxane, 2-(carboxymethylthio)ethyltrimethylsilane, and the like.

Functionalized organosilanes, particularly those with trialkyloxysilyl groups such as 3-aminopropyltriethoxysilane (γ-APS), 3-mercatpopropyltrimethoxysilane, 3-glycidoxypropyltrimethoxysilane, and methacryloxypropyltriehtoxysilane have been applied in organic photoreceptors, organic light-emitting diodes and other opto-electronic devices with good results. After the hydrolysis process, the organosilanes can be converted to hybrid materials. In organic photoreceptor devices, the hydrolyzed silane layer functions not only as a charge blocking agent but also as an adhesive material for the substrate and the interfacial layers (IFL). In specific embodiments, depicted in FIG. 2, the structure of hydrolyzed organosilane should be configured such that the siloxane segments 40 are connected with the metal substrate 45, and the functional groups 50 are on the surface of the charge blocking layer 55 to interact with the organic materials in the IFL (not shown).

Figure 2:
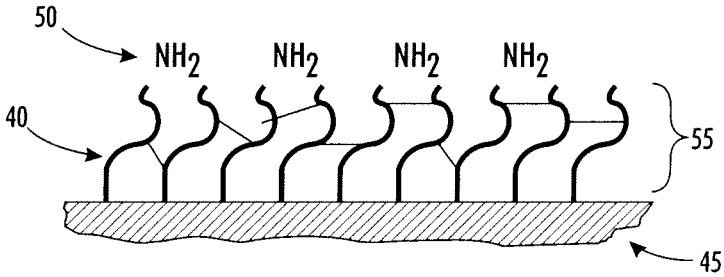
FIG. 2 is a representation of the structure of hydrolyzed organosilane in the charge blocking layer according to the present embodiments.

Mesoscopically ordered hybrid materials can be obtained through surfactant-mediated hydrolysis of organosilanes. In the aqueous coating solution with the surfactant, the ordered inorganic-organic hybrid material is formed in a nano-sized micelle structure. This key structure feature can dramatically increase the bonding possibility of Si—OH with metallic element on the substrate. Subsequently, through drying, a layered and well-structured charge blocking layer structure can be obtained as illustrated in FIG. 2. In organic solvent-involved hydrolysis processes of organosilanes, the formed hybrid material can be easily precipitated out if no process control is applied. Due to the instable precipitates, such conventional coating solutions generally have short shelf-life times and easily cause coating defects.

Thus, in the present embodiments, the coating solution incorporates one or more functionalized organosilanes which may be present in the coating solution in an amount of from about 0.01 percent to about 30 percent by weight of the total weight of the coating solution. The surfactant in the coating solution may be an anionic surfactant. In particular embodiments, the surfactant may be selected from the group consisting of sodium dodecylbenzenesulfonate, sodium dodecyl sulfate, ammonium lauryl sulfate, sodium lauryl ether sulfate, alkylbenzene sulfonate, alkyl sulfate salts and sodium alkyl carboxylate, and the like, and mixtures thereof. The surfactant may be present in the coating solution in an amount of from about 0.0001 percent to about 10 percent by weight of the total weight of the coating solution.

In the present embodiments, the charge blocking layer is formed from an aqueous-based coating solution. The main coating solvent is water which present in the amount from 50 percent to 99.99 percent by weight of all solvents. The coating solution may optionally have a small amount of other water-miscible solvents such as methanol, ethanol, propanol, acetone, tetrahydrofuran, dimethylformamide, N-methylpyrrolidinone, acetic acid and mixtures thereof and the like. In any event, the coating solution avoids the need to use an organic solvent, for example, petroleum products. The solvent may be present in the coating solution in an amount of from about 0.01 percent to about 50 percent by weight of the total weight of the coating solution.

A charge blocking layer formed from the present embodiments of coating solution provides an improved imaging member wherein the charge blocking layer exhibits an improved adhesion to the substrate as compared to a charge blocking layer formed from a coating solution without the surfactant. For example, the charge blocking layer does not peel from the substrate in an adhesion test performed on an Instron® device. In specific embodiments, the improved imaging member comprises a metallized substrate, for which the coating solution provides good adhesion to and coating capability. In embodiments, the substrate comprises a metal selected from the group consisting of titanium, zirconium, aluminum, copper, zinc, nickel, and mixtures thereof.

The Charge Generation Layer

The charge generation layer 18 may thereafter be applied to the charge blocking layer 14. Any suitable charge generation materials including a charge generating/photoconductive material, which may be in the form of particles and dispersed in a film forming binder, such as an inactive resin, may be utilized. Examples of charge generating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, enzimidazole perylene, and the like, and mixtures thereof, dispersed in a film forming polymeric binder. Selenium, selenium alloy, benzimidazole perylene, and the like and mixtures thereof may be formed as a continuous, homogeneous charge generation layer. Benzimidazole perylene compositions are well known and described, for example, in U.S. Pat. No. 4,587,189, the entire disclosure thereof being incorporated herein by reference. Multi-charge generation layer compositions may be used where a photoconductive layer enhances or reduces the properties of the charge generation layer. Other suitable charge generating materials known in the art may also be utilized, if desired. The charge generating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

Any suitable inactive resin materials may be employed as a binder in the charge generation layer 18, including those described, for example, in U.S. Pat. No. 3,121,006, the entire disclosure thereof being incorporated herein by reference. The binders may be selected from those described above in regards to the overcoat layer.

The charge generating material can be present in the resinous binder composition in various amounts. Generally, at least about 5 percent by volume, or no more than about 90 percent by volume of the charge generating material is dispersed in at least about 5 percent by volume, or no more than about 90 percent by volume of the resinous binder, and more specifically at least about 20 percent, or no more than about 60 percent by volume of the charge generating material is dispersed in at least about 30 percent by volume, or no more than about 70 percent by volume of the resinous binder composition.

In specific embodiments, the charge generation layer 18 may have a thickness of at least about 0.01 microns, or no more than about 2 microns, or of at least about 0.2 microns, or no more than about 1 microns. The charge generation layer thickness is generally related to binder content. Higher binder content compositions generally employ thicker layers for charge generation.

The Charge Transport Layer

In the photoreceptor, the charge transport layer comprises a single layer of the same composition. As such, the charge transport layer will be discussed specifically in terms of a single layer 20, but the details will be also applicable to an embodiment having dual charge transport layers. The charge transport layer 20 is thereafter applied over the charge generation layer 18 and may include any suitable organic polymer or non-polymeric material capable of supporting the injection of photogenerated holes or electrons from the charge generation layer 18 and capable of allowing the transport of these holes/electrons through the charge transport layer to selectively discharge the surface charge on the imaging member surface. In one embodiment, the charge transport layer 20 not only serves to transport holes, but also protects the charge generation layer 18 from abrasion or chemical attack and may therefore extend the service life of the imaging member. The charge transport layer 20 can be a substantially non-photoconductive material, but one which supports the injection of photogenerated holes from the charge generation layer 18.

In addition, in the present embodiments using a belt configuration, the charge transport layer may consist of a single pass charge transport layer or a dual pass charge transport layer (or dual layer charge transport layer) with the same or different transport molecule ratios. In these embodiments, the dual layer charge transport layer has a total thickness of from about 10 microns to about 40 microns. In other embodiments, each layer of the dual layer charge transport layer may have an individual thickness of from 2 microns to about 20 microns. Moreover, the charge transport layer may be configured such that it is used as a top layer of the photoreceptor to inhibit crystallization at the interface of the charge transport layer and the overcoat layer. In another embodiment, the charge transport layer may be configured such that it is used as a first pass charge transport layer to inhibit microcrystallization occurring at the interface between the first pass and second pass layers.

The layer 20 is normally transparent in a wavelength region in which the electrophotographic imaging member is to be used when exposure is affected there to ensure that most of the incident radiation is utilized by the underlying charge generation layer 18. The charge transport layer should exhibit excellent optical transparency with negligible light absorption and no charge generation when exposed to a wavelength of light useful in xerography, e.g., 400 to 900 nanometers. In the case when the photoreceptor is prepared with the use of a transparent substrate 10 and also a transparent or partially transparent conductive layer 12, image wise exposure or erase may be accomplished through the substrate 10 with all light passing through the back side of the substrate. In this case, the materials of the layer 20 need not transmit light in the wavelength region of use if the charge generation layer 18 is sandwiched between the substrate and the charge transport layer 20. The charge transport layer 20 in conjunction with the charge generation layer 18 is an insulator to the extent that an electrostatic charge placed on the charge transport layer is not conducted in the absence of illumination. The charge transport layer 20 should trap minimal charges as the charge passes through it during the discharging process.

The charge transport layer 20 may include any suitable charge transport component or activating compound useful as an additive dissolved or molecularly dispersed in an electrically inactive polymeric material, such as a polycarbonate binder, to form a solid solution and thereby making this material electrically active. "Dissolved" refers, for example, to forming a solution in which the small molecule is dissolved in the polymer to form a homogeneous phase; and molecularly dispersed in embodiments refers, for example, to charge transporting molecules dispersed in the polymer, the small molecules being dispersed in the polymer on a molecular scale. The charge transport component may be added to a film forming polymeric material which is otherwise incapable of supporting the injection of photogenerated holes from the charge generation material and incapable of allowing the transport of these holes through. This addition converts the electrically inactive polymeric material to a material capable of supporting the injection of photogenerated holes from the charge generation layer 18 and capable of allowing the transport of these holes through the charge transport layer 20 in order to discharge the surface charge on the charge transport layer. The high mobility charge transport component may comprise small molecules of an organic compound which cooperate to transport charge between molecules and ultimately to the surface of the charge transport layer. For example, but not limited to, N,N'-diphenyl-N,N-bis(3-methyl phenyl)-1,1'-biphenyl-4,4'-diamine (TPD), other arylamines like triphenyl amine, N,N,N',N'-tetra-p-tolyl-1,1'-biphenyl-4,4'-diamine (TM-TPD), and the like.

A number of charge transport compounds can be included in the charge transport layer, which layer generally is of a thickness of from about 5 to about 75 microns, and more specifically, of a thickness of from about 15 to about 40 microns.

Examples of specific aryl amines that can be selected for the charge transport layer include N,N'-diphenyl-N,N'-bis (alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules may be selected in embodiments, reference for example, U.S. Pat. Nos. 4,921,773 and 4,464,450, the disclosures of which are totally incorporated herein by reference.

Examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), and epoxies, and random or alternating copolymers thereof. In embodiments, the charge transport layer, such as a hole transport layer, may have a thickness of at least about 10 microns, or no more than about 40 microns.

Any suitable and conventional technique may be utilized to form and thereafter apply the charge transport layer mixture to the supporting substrate layer. The charge transport layer may be formed in a single coating step or in multiple coating steps. Dip coating, ring coating, spray, gravure or any other drum coating methods may be used.

Drying of the deposited coating may be effected by any suitable conventional technique such as oven drying, infra red radiation drying, air drying and the like. The thickness of the charge transport layer after drying is from about 10 microns to about 40 microns or from about 12 microns to about 36 microns for optimum photoelectrical and mechanical results. In another embodiment the thickness is from about 14 microns to about 36 microns.

The Adhesive Layer

An optional separate adhesive interfacial layer may be provided in certain configurations, such as for example, in flexible web configurations. In the embodiment illustrated in FIG. 1, the interfacial layer would be situated between the blocking layer 14 and the charge generation layer 18. The interfacial layer may include a copolyester resin. Exemplary polyester resins which may be utilized for the interfacial layer include polyarylate, polyvinylbutyrals, such as ARDEL POLYARYLATE (U-100) commercially available from Toyota Hsutsu Inc., VITEL PE-100, VITEL PE-200, VITEL PE-200D, and VITEL PE-222, all from Bostik, 49,000 polyester from Rohm Hass, polyvinyl butyral, and the like. The adhesive interfacial layer may be applied directly to the hole blocking layer 14. Thus, the adhesive interfacial layer in embodiments is in direct contiguous contact with both the underlying hole blocking layer 14 and the overlying charge generation layer 18 to enhance adhesion bonding to provide linkage. In yet other embodiments, the adhesive interfacial layer is entirely omitted.

The adhesive interfacial layer may have a thickness of at least about 0.005 micron, or no more than about 9 microns after drying. In embodiments, the dried thickness is from about 0.01 micron to about 1 microns.

Anti-curl back coating 1 may be formed at the back side of the substrate 2, opposite to the imaging layers. The anti-curl back coating may comprise a film forming resin binder and an adhesion promoter additive. The resin binder may be the same resins as the resin binders of the charge transport layer discussed above. Examples of film forming resins include polyacrylate, polystyrene, bisphenol polycarbonates such as poly (4,4'-isopropylidene diphenyl carbonate) and 4,4'-cyclohexylidene diphenyl polycarbonate, and the like. Adhesion promoters used as additives include 49,000 (du Pont), Vitel PE-100, Vitel PE-200, Vitel PE-307 (Goodyear), and the like. Usually from about 1 to about 15 weight percent adhesion promoter is selected for film forming resin addition. The thickness of the anti-curl back coating is at least about 3 microns, or no more than about 35 microns, or about 14 microns, which is totally decided by the flatness requirement of the photoreceptor devices.

Various exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The example set forth herein below and is illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

Example 1

Preparation of the Coating Solution:

To 99 grams of deionized water stirred by a magnetic bar, 3-aminopropyltrimethoxysilane 1.0 g, anionic surfactant sodium dodecylbenzenesulfonate 0.01 g and acetic acid 0.1 g were added consequently. After being stirred for 18 hours at room temperature, a slightly milky solution was obtained. To test the stability of the coating solution, the solution was sat on bench for one week without any agitation. No precipitate could be observed.

Example 2

Preparation of the Photoreceptor Devices:

Next, the coating and drying step was conducted. The coating solution was coated on a titanium/zirconium metallized polyester substrate, using a Bird-bar having a gap of volume 0.5-mil or of length 0.5-in. After being dried in an air-flowing hood at about 22° C., the coated substrate was dried in a 120° C. oven for 1 minute (sample ID # 1), 3 minutes (sample ID # 2), and 5 minutes (sample ID # 3) respectively for 3 different samples.

Next, full photoreceptor devices were fabricated based on the coated samples. On the above prepared substrates with the inventive charge blocking layers, an IFL layer, a charge generation layer and a charge transport layer were formed by hand-coating, using conventional solutions for the respective layers. The full devices incorporated the sample IDs from the above charge blocking layer coating process. Another photoreceptor device was used as a control (sample ID # 4). The full device fabrication is described in U.S. Pat. No. 7,344,809, which is hereby incorporated by reference.

Example 3

Photoreceptor Device Testing and Evaluation:

Adhesion Test

An adhesion test was conducted on the above photoreceptor devices. A peel test by Instron® was performed to measure the adhesion of the charge blocking layer with substrate. The 180-degree peel strength is determined by cutting a minimum of five 0.5 inch times 6 inches imaging member samples from each of Examples 1 through 4. For each sample, the photoreceptor layer is partially stripped from the test imaging substrate with the aid of a razor blade and then hand peeled to about 3.5 inches from one end to expose part of metalized substrate. The end of the resulting bare substrate is inserted into the lower jaw of an Instron® Tensile Tester. The free end of the partially peeled photoreceptor strip is inserted into the upper jaw of the Instron® Tensile Tester. The jaws are then activated at a 1 inch/min crosshead speed, a 2 inch chart speed, and a load range of 200 grams, to 180 degrees to peel the sample at least 2 inches. The load monitored with a chart recorder is calculated to give the peel strength by dividing the average load in grams/0.5 inches required for stripping the photoreceptor layer with the substrate by 12.7 millimeter/0.5 inches and multiplying by 10 millimeter/centimeter to get a value with units of grams/centimeter. The test was repeated 3 times for each sample. The average peel strength of each sample is shown in Table 1.

TABLE 1

| | Sample ID | | | |
|---|---|---|---|---|
| | #1 | #2 | #3 | #4 |
| Peel Strength (gram/cm) | do not peel | do not peel | 65.12 | 75.09 |

The adhesion test results in Table 1 demonstrated that the photoreceptors with the inventive coating solutions showed excellent adhesion, compared to conventional photoreceptor devices. Sample #3 showed slightly lower adhesion, which may be related to the longer drying time at high temperature The yellowish charge blocking layer after 5-minute (ID #3) drying at 120° C. was obtained Electrical Property Test The full photoreceptor devices were tested by a Xerox 4000 scanner. The electrical properties of the samples after 10,000 cycling test are shown in Table 2. The results demonstrated that, even though the samples were hand-coated, the devices still exhibited very good electrical properties.

TABLE 2

| Sample ID | $V_0$ | $V_{dd}$ | $V_{cyc\text{-}up}$ |
|---|---|---|---|
| #1 | 800 | 23.3 | 47.2 |
| #2 | 800 | 22.5 | 48.1 |
| #3 | 800 | 24.0 | 27.5 |
| #4 | 800 | 50.1 | 7.1 |

With reference to the abbreviations employed in Table 2:

V0 is the initial charging voltage applied on the device;

Vdd is the lost potential before light exposure.

$V_{cyc\text{-}up}$ is the erase voltage change after 10,000 cycling test.

All the patents and applications referred to herein are hereby specifically, and totally incorporated herein by reference in their entirety in the instant specification.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. An imaging member comprising:

a substrate;

a charge blocking layer disposed on the substrate;

an adhesive interfacial layer disposed on the charge blocking layer;

a charge generation layer disposed on the interfacial layer; and a charge transport layer disposed on the charge generation layer, wherein the adhesive interfacial layer is disposed between the charge blocking layer and the charge generation layer, and further wherein the charge blocking layer is formed from an aqueous-based coating solution, the aqueous-based coating solution comprising one or more functionalized organosilanes, a surfactant, and a solvent.

2. The imaging member of claim 1, wherein the one or more functionalized organosilanes in the coating solution is selected from the group consisting of 3-aminopropyl triethoxysilane, 3-mercaptpropyltrimethoxysilane, 3-glycidoxypropyltrimethoxysilane, methacryloxypropyltriethoxysilane, and mixtures thereof.

3. The imaging member of claim 1, wherein the surfactant in the coating solution is selected from the group consisting of sodium dodecylbenzenesulfonate, sodium dodecyl sulfate, ammonium lauryl sulfate, sodium lauryl ether sulfate, alkylbenzene sulfonate, alkyl sulfate salts, sodium alkyl carboxylate, and mixtures thereof.

4. The imaging member of claim 1, wherein the charge blocking layer has a peel strength of at least 50 gram/cm to not peel-able.

5. The imaging member of claim 1, wherein the substrate has a metalized conductive surface.

6. The imaging member of claim 5, wherein the substrate comprises a metal selected from the group consisting of titanium, zirconium, aluminum, copper, zinc, nickel, and mixtures thereof.

7. The imaging member of claim 1, wherein the charge blocking layer is continuous and has a thickness of from about 0.005 micron to about 0.3 micron.

8. An imaging member comprising:

a substrate;

a charge blocking layer disposed on the substrate; and an adhesive interfacial layer disposed on the charge blocking layer;

a charge generation layer disposed on the interfacial layer; and a charge transport layer disposed on the charge generation layer, wherein the adhesive interfacial layer is disposed between the charge blocking layer and the charge generation layer, and further wherein the charge blocking layer is formed from an aqueous-based coating solution, the aqueous-based coating solution comprising one or more functionalized organosilanes, a surfactant, and a solvent and the charge blocking layer has a peel strength of at least 50 gram/cm.

9. The imaging member of claim 1, wherein the charge blocking layer comprises a nano-sized micelle structure of hydrolyzed organosilane.

* * * * *